United States Patent [19]

Casto et al.

[11] Patent Number: 4,721,394

[45] Date of Patent: Jan. 26, 1988

[54] MIXING BLADE CONSTRUCTION

[75] Inventors: Leo V. Casto, Brecksville; Peter M. Reif, Lyndhurst, both of Ohio

[73] Assignee: Pro-Quip, Inc., Macedonia, Ohio

[21] Appl. No.: 747,859

[22] Filed: Jun. 24, 1985

[51] Int. Cl.[4] ..... B01F 5/10

[52] U.S. Cl. ..... 366/343; 366/330; 416/241 A; 416/243

[58] Field of Search ..... 366/270, 330, 343, 279, 366/331; 416/224, 241 A, 243

[56] References Cited

U.S. PATENT DOCUMENTS

| | | | |
|---|---|---|---|
| 2,460,902 | 2/1949 | Odor | 416/243 |
| 2,524,870 | 10/1950 | Adamtchik | 416/243 |
| 3,357,850 | 12/1967 | Baker | 416/241 A X |
| 3,758,231 | 9/1973 | Barnstead | 416/241 A X |
| 4,519,715 | 5/1985 | Golobic et al. | 366/343 |
| 4,571,090 | 2/1986 | Weetman et al. | 366/343 X |

FOREIGN PATENT DOCUMENTS

| | | | |
|---|---|---|---|
| 78660 | 5/1983 | European Pat. Off. | 366/330 |

*Primary Examiner*—Philip R. Coe

*Attorney, Agent, or Firm*—D. Peter Hochberg; Mark M. Kusner; Walter C. Danison, Jr.

[57] ABSTRACT

A mixing blade assembly including a hub, a set of impeller blades having air foil configurations and flat end portions for attachment to corresponding flat surfaces of mounting members which attach the blades to the hub. The flat attachment surfaces avoid stresses tending to distort the blades. The hub is a hollow member made from a set of plates. The leading edges of the blades are generally straight, and the trailing edges are inclined rearwardly from the tips towards the roots of the blades.

8 Claims, 8 Drawing Figures

MIXING BLADE CONSTRUCTION

BACKGROUND OF THE INVENTION

This invention relates to apparatus for mixing fluids, and in particular to mixing blade constructions for mixing liquids in containers.

Mixing blade constructions in the form of turbines or impellers for mixing liquids and for suspending solids in liquid-solid slurries in tanks and other containers are known and widely used. (The terms mixing blade assembly, turbine and impeller are used interchangeably herein). In the course of the development of such blade constructions, it has been recognized that there are competing factors to be considered in designing mixing blade assemblies and in evaluating their performance. On one hand, there should be a high degree of mixing. This is best achieved by providing for a high degree of axial flow of the fluid in the direction of the axis of rotation of the mixing device. Other less productive flow patterns are radial and tangential or rotary. On the other hand, there should be a low power consumption for achieving the mixing of the fluid. The performance of a mixing blade can be expressed in terms of its pumping efficiency:

$$e = Q/P$$

where e=pumping efficiency

Q=axial fluid flow rate (pumping output)

P=power consumed (power input)

A number of factors affect the axial flow rate. There is ideally purely axial flow as the mixing blades of the mixing blade assembly turn through the fluid. In other words, a force analysis of the respective blades ideally consists of axial force vectors. In actuality, there are rotational or drag forces which resist rotation of the blades as well. Marine turbines having very high axial flow characteristics are known, but in all but very small tanks the size of the blades makes marine turbines inappropriate for mixing applications. Standard axial flow turbines yield a high degree of axial flow, but the presence of significant radial components results in a stagnant region of fluid near the turbine. Impellers for fluid mixing purposes are configured in special ways in efforts to achieve high axial flow. For example, U.S. Pat. No. 4,147,437 proposes a curved plate airfoil impeller to obtain an axial flow pattern. Controlled axial flow over long distances improves the degree of mixing both through greater vertical distance of fluid movement from the impeller, and enhanced secondary mixing flow patterns, and enables the disposition of the mixing blade assembly high in the tank; the high location makes possible a shorter drive shaft, and further prevents the impeller from getting stuck in slurry accumulating near the bottom of the mixing vessel. Likewise, enhanced axial flow can be used to mix liquid at any depth by positioning an impeller near the base of the vessel for pumping liquid upwardly. U.S. Pat. No. 4,468,130 proposes a mixer blade construction which incorporates a geometric pitch angle (the angle between the chord line of the curved blade and a plane perpendicular to the axis of the drive shaft) which increases from the tip of the blade to the base and which is at the threshold for fluid flow separation from the surfaces of the blade so that maximum axial flow occurs before separation begins.

While efforts have been made to achieve high degrees of axial flow, there are other effects which detract from wholly axial flow. The energy expended in the non-axial flow detracts from the efficiency of the mixing blade assembly. Thus, the presence of turbulence on the blade surface adversely affects axial flow and increases rotational drag and the power required. Various efforts have been made to reduce the likelihood of such turbulence as the impeller rotates through the fluid in the mixing vessel. It is desirable to operate at an angle of attack (the angle of incidence of the fluid on the average chord of the blade profile) well below the stall angle of the blade. Although the foregoing U.S. Pat. No. 4,468,130 proposes operating at the threshold for fluid flow separation from the blades, such a design could result in undesired flow separation and turbulence when there are two phase fluid systems involved or when the impeller speed changes. It is recognized that turbulence can be reduced by appropriately rounding the leading edges of the impeller blades. It is known to provide these leading edges with cylindrical and elliptical shapes.

The efficiency of mixing blade assemblies can be increased by reducing the energy or power required to achieve a given axial flow rate. Thus, the drag of the device should be reduced as much as possible. Turbulence on the blade surface increases drag. When provision is made to locate the impeller high in the mixing vessel, the length and diameter of the shaft can be reduced. Shorter shafts can be rotated faster than long shafts since shaft vibration increases with length. Besides, shorter shafts are less expensive. Impeller blades in the form of airfoils can be made lighter than flat blades; thin blades are desirable since they are lighter and can be easier to turn. Likewise, the impeller hub should be as light as possible, yet most hubs are cast pieces and are therefore necessarily massive and heavy.

While a high pumping efficiency is very important, there are other factors which are crucial in the overall evaluation of a mixing blade assembly. The assembly should be durable. Impellers for mixing fluids normally must endure significant loads for long periods of time. Complex force and torsion loads are applied to the impeller, and the rotation of the device can result in vibration-caused stresses. Thus, desirable as thin blades may be for example, the blades must be rugged enough to withstand the loads to which they are subjected. Mixing turbines generally comprise a set of vanes attached to a hub. The juncture of the vane and the hub has to be strong. Weak areas can occur when the blade is curved, such as when there is a tendency of the blade to flatten at the juncture as where a curved blade is bolted to a flat surface of the hub. U.S. Pat. No. 4,468,130 noted previously proposes decreasing the camber (the relative sag, which is ratio of the maximum distance between the chord of a blade and the mean line running through the blade across its width) from the tip of the blade to its root to improve the axial fluid flow; however, such an arrangement sacrifices the strength of the blade near the point of attachment.

Impellers are sometimes used to mix corrosive fluids. It is desirable to minimize the corrosive effect on the impeller. Conventional impellers sometimes have exposed surfaces, as between the hub and the vane, where the corrosive fluid can collect.

SUMMARY OF THE INVENTION

It is an object of the invention to provide an improved impeller apparatus for mixing fluids.

Another object is to provide a mixing impeller of increased efficiency.

A further object is the provision of an impeller which effects substantially axial fluid flow.

The provision of an impeller which can be positioned high in a mixing vessel while effectively mixing the fluid is another object of the invention.

Another object is to provide an impeller having a low likelihood of turbulence during its mixing of fluids.

An additional object is the provision of an impeller blade which is both light and strong enough to withstand the loads to which it is subjected.

The provision of a light yet strong impeller hub is another object of the invention.

A still further object of the invention is an improved impeller wherein the blades are attached to the hub in a manner which assures a strong juncture and does not tend to distort the blade.

Another object is to reduce the shock loads to which a mixing impeller and shaft are likely to be subjected.

Still another object is to provide a versatile impeller which reduces the need for additional impellers as the depth of fluid to be mixed increases.

It is an additional object to provide an impeller apparatus wherein the impeller can be mounted at the end of a drive shaft and located near the fluid surface or near the base of the fluid vessel to provide a long axial flow path through the fluid, the apparatus being capable of thoroughly mixing the fluid over that axial flow path.

Yet another object is to provide an impeller which can be modified easily to change its capacity.

It is another object to provide an impeller which withstands the deleterious effects of corrosive fluids which it mixes.

Still an additional object is to provide an improved impeller which is practicable to manufacture, effective and efficient in operation, and of a strength and durability sufficient to perform its mixing function over prolonged periods. Other objects will be apparent from the description to follow and from the appended claims.

The foregoing objects are achieved according to the preferred embodiment of the invention by the provision of an impeller having airfoil blades attached to the flat surfaces of a hub. The blades are configured to operate at an angle of attack well below the stall angle to avoid blade surface turbulence and/or flow separation under operating conditions. The impeller blades are configured to assure a high degree of axial flow. Such flow makes it possible to locate the impeller high in the tank to pump downwardly or low in the tank to pump upwardly. These dispositions reduce the likelihood of shock loads as the liquid level changes, and reduce the need for additional impellers for different batch sizes. Each blade is configured to effect a uniform velocity of discharge along the radius. Such uniform velocity makes it possible to use one basic blade pattern for many sizes, since the blade can in effect be shortened to reduce its capacity without having to change blade configuration. The camber of the preferred blade increases from its tip where the load is low to its root where the load is very high. This strengthens the blade as the load increases along the blade length. Such construction enables a thinner blade construction and a lower angle of attack to reduce the power required to drive the impeller. The hub is constructed from plates, and is light yet strong. The blades are provided at their root portions with flat support pieces, which can be secured to the flat hub surfaces without tending to flatten the blades while assuring an extensive area of engagement between the blade support and the hub.

DETAILED DESCRIPTION OF THE PREFERRED EMBODIMENTS

Figure 1:
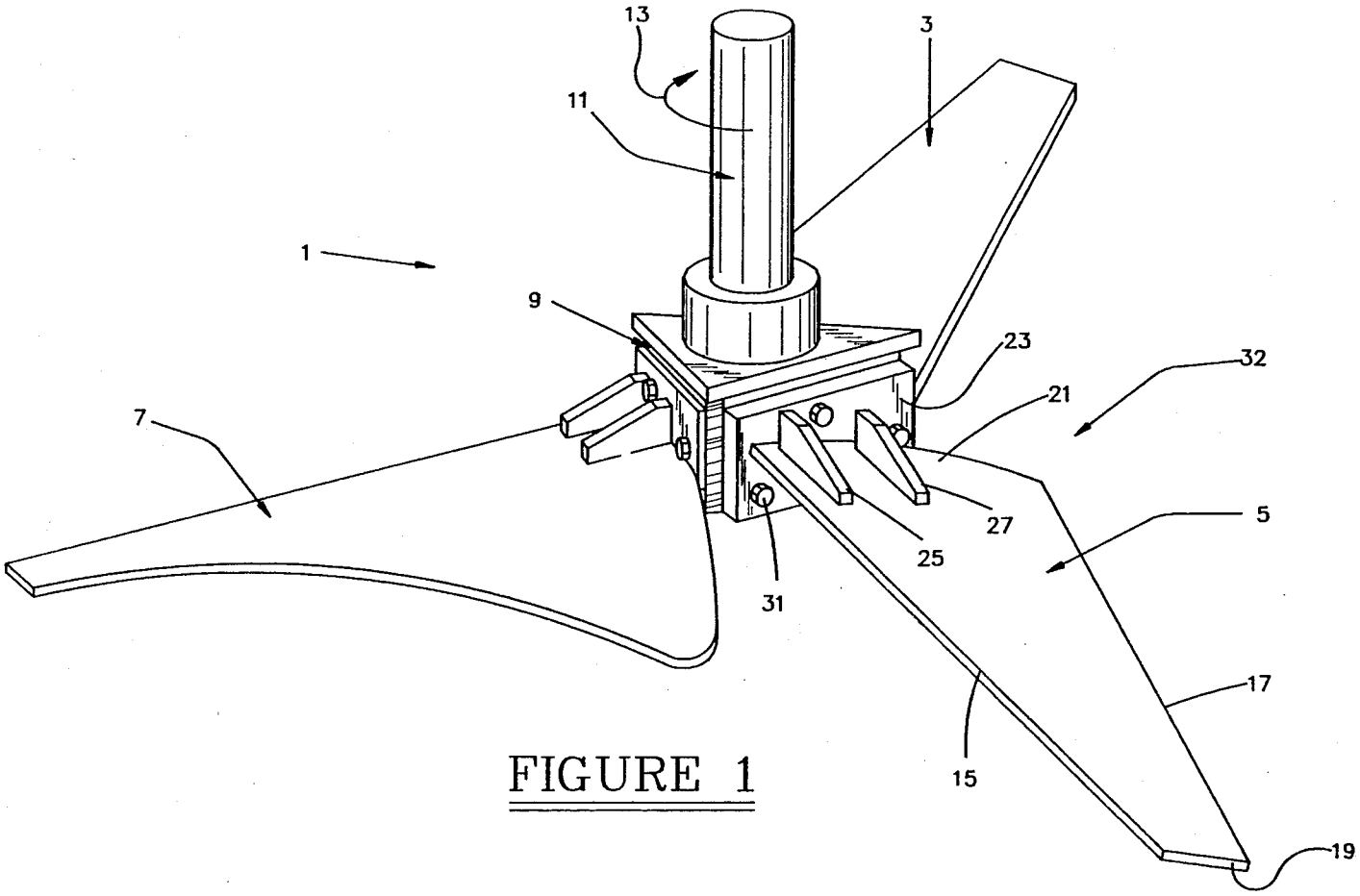
FIG. 1 is a perspective view of an impeller assembly according to the preferred embodiment of the invention.

Referring to FIGS. 1–4, a mixing blade or impeller assembly 1 is shown which includes a set of three blades 3, 5 and 7 extending from a hub 9 to which they are attached. Hub 9 is attached to a drive shaft 11 which is driven by an appropriate motor.

Hub 9 is rotated in the clockwise direction indicated by arrow 13, by shaft 11. Blades 3, 5 and 7 are identical. Blade 5, like the other blades, has a leading edge 15 and a trailing edge 17. Blade 5 further has a free end portion or tip 19, and a base or root 21 by which blade 5 is attached to hub 9. Blade 5 is attached to a flat support plate 23 by means of a weldment. A pair of stiffening members or gussets 25, 27 are welded between blade 5 and support plate 23. Support plate 23 has a set of bolt holes 29 (FIG. 4) for receiving bolts 31. Blade 5, support plate 23 and gussets 25 and 27 form a blade assembly 32. Blades 3 and 7 form part of like blade assemblies.

Hub 9 is composed of three side plates 33, 35 and 37 which are welded together to form a structure of generally triangular cross section. The lower or free end of hub 9 has a lower end plate 39, and the upper end of hub 9 has an end plate 41, the end plates being welded to the side plates to form a rigid, hollow structure. Securement means in the form of a cylindrical attachment piece 43 is welded to end plate 41. Attachment piece 43 has a radial hole 45 for receiving a set screw, and an axial hole 46 for receiving shaft 11.

Figure 4:
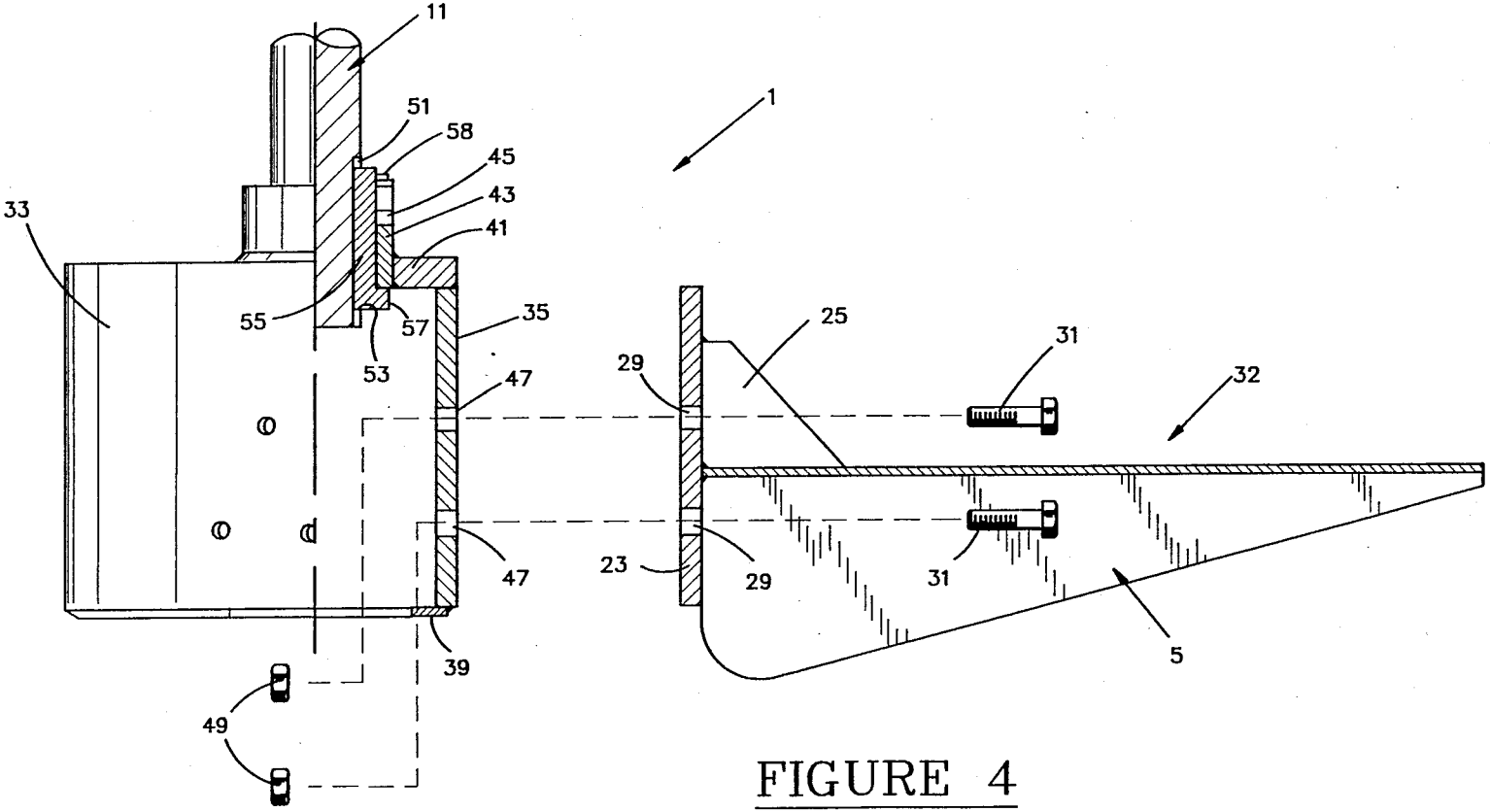
FIG. 4 is an exploded view taken in the direction 4—4 in FIG. 3.

Blade assembly 32 is removably attachable to hub 9. Side plate 35 of hub 9 has a set of screw holes 47 which are alignable with screw holes 29 of support plate 23. Blade assembly 32 is attached to hub 9 by aligning bolt holes 29 and 47 as shown in FIG. 4 and inserting bolts 31 through the holes and securing them with a set of nuts 49. As indicated in FIGS. 1 and 4, there are three sets of holes 29, 47, bolts 31 and nuts 49 for attaching blade assembly 32 to hub 9. It is significant that the juncture of support plate 23 and of hub side plate 35 is flat and intimate. This effects a sound mechanical joint between the parts, with the blade assembly securely affixed to the hub without stressing or deforming the blade.

Hub 9 is removably attachable to shaft 11. As shown in FIG. 4, shaft 11 has a recessed portion 51 which terminates near the lower, free end of the shaft in a shoulder 53. A step key 55 is disposed in portion 51 where it rests on shoulder 53. Key 55 itself has a shoulder 57. Hub 9 can be attached to shaft 11 by positioning the lower end of the shaft within attachment piece 43, with the lower end of piece 43 resting on shoulder 57. By tightening a set screw in hole 45 against step key 55, fretting corrosion caused by rubbing between adjacent parts 43, 45 and 51 is prevented. This operation can be accomplished prior to the attachment of the blade assemblies to side plates 33, 35 and 37. This is clearly a straightforward operation which can be performed by an unskilled workman. Once the hub is assembled on shaft 11, it is secure against falling off the shaft even if the set screw is accidentally withdrawn from hole 45, since shoulder 57 prevents the falling of hub 9 from shaft 11. A lug 58 or the like can be located at the opposite end of key 51 from shoulder 57 for preventing the hub assembly from riding up shaft 11.

The construction of hub 9 has numerous advantages over the cast hubs of the prior art. The welded plate construction renders the hub strong yet light. Furthermore, the light hub reduces the requisite strength and stiffness of the shaft.

Figure 5:
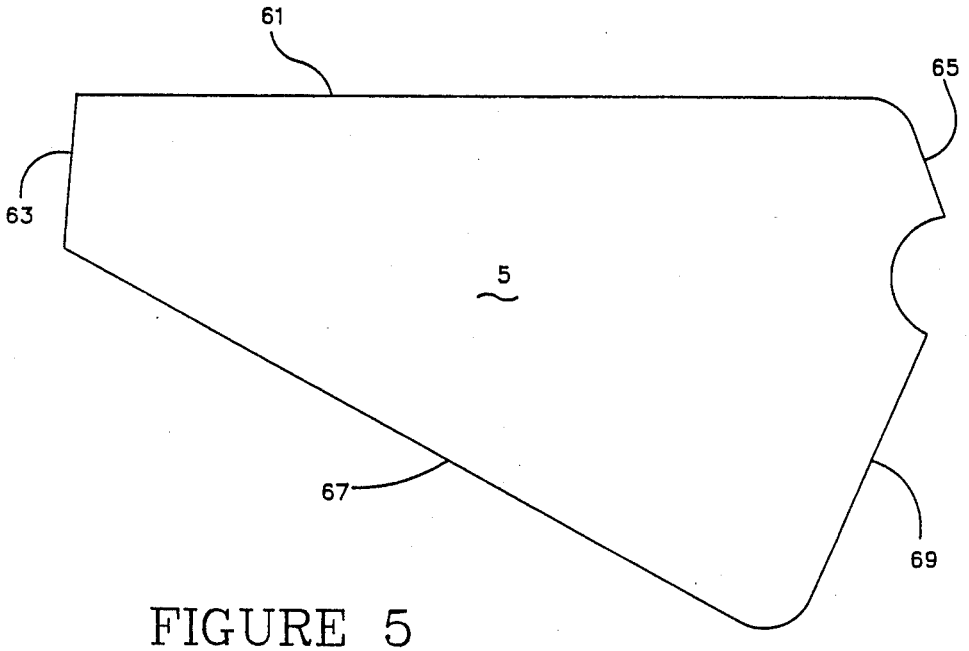
FIG. 5 is a plan view of a blade of the impeller assembly shown in the preceding figures.
Figure 6:
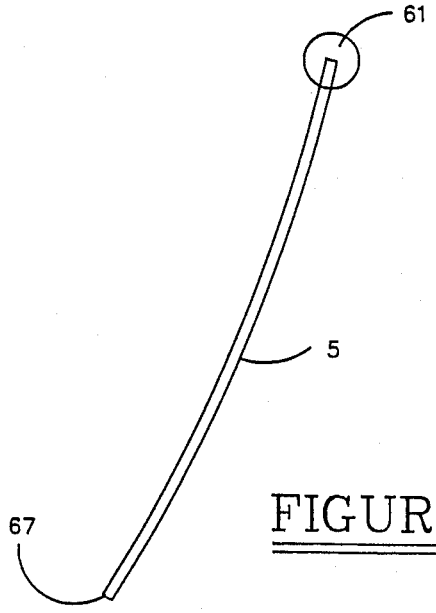
FIG. 6 is a view taken in the direction 6—6 in FIG. 5.

The blades according to the preferred embodiment of the invention have various significant features. Turning to FIGS. 5 and 6 which show blade 5 in detail, each blade can be seen as including a substantially straight leading edge 61 extending from a slightly curved tip portion 63, and terminating at a sharply inclined edge 65 at the root end of the blade. A trailing edge 67 of blade 5 extends from tip 63 to an edge 69 at the root of the blade; edge 69 is straight and is directed to converge with an extension of edge 65. The leading edge 61 of blade 5 is curved as shown in the insert to reduce the drag on the blade and to reduce the likelihood of fluid turbulence and flow separation. Preferably, this leading edge is in the form of a semi-cylinder having a radius of one-half of the thickness of the blade. The trailing edge 67 can have a flat surface normal to the faces of the blade.

Figure 2:
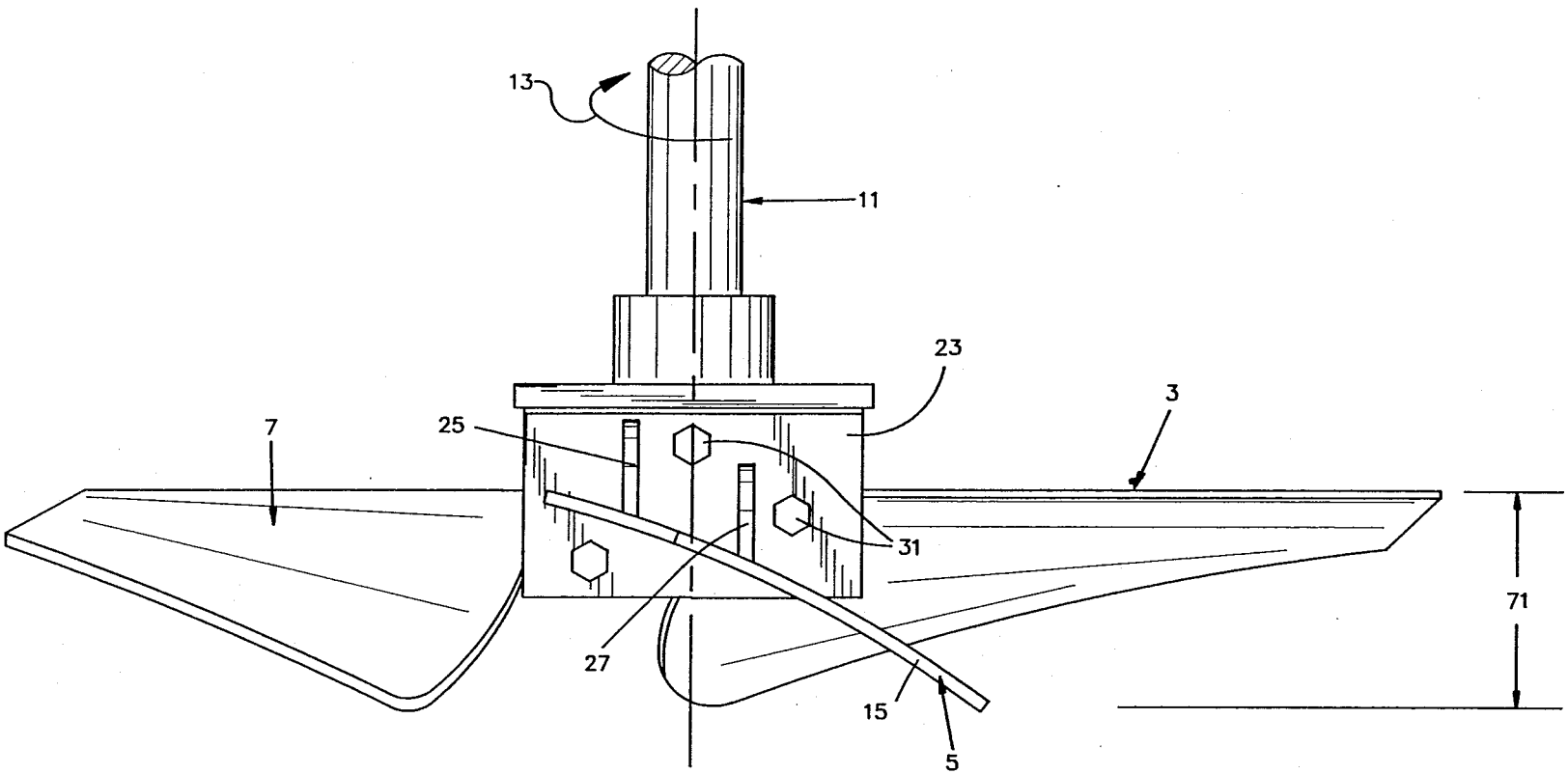
FIG. 2 is a side view of the impeller assembly shown in FIG. 1.
Figure 3:
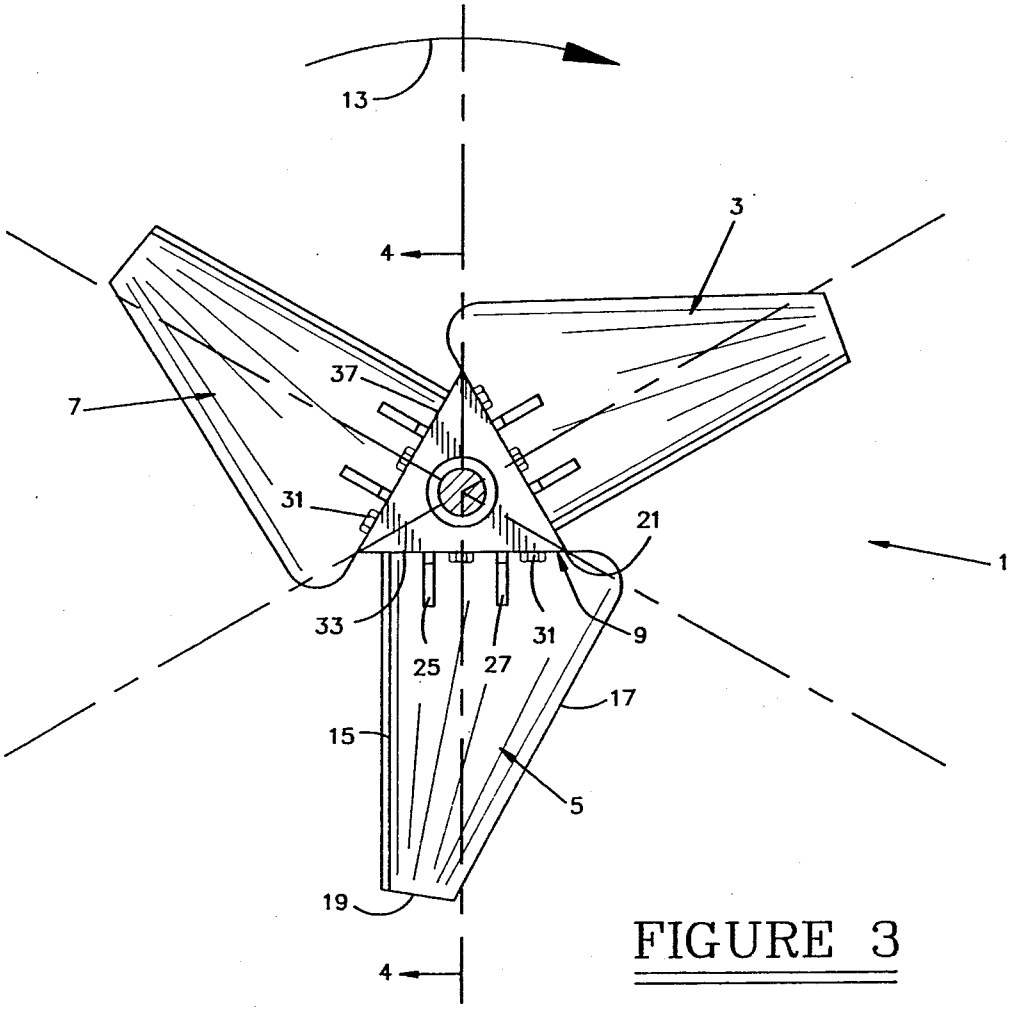
FIG. 3 is a top view of the impeller assembly shown in FIG. 1.

FIGS. 2 and 6 show that blades 3, 5 and 7 are airfoils, and are curved in accordance with viscid flow theory design to minimize drag force, provide desired axial flow at high volume, and provide a high strength-to-weight ratio. The camber of the present blades increases from tip 63 to the root end of the blade, to strengthen the blade from tip to root to compensate for a like increase in stress in the blade from tip to root. Such configuration reduces the weight of the blade for a commensurate reduction in the power required to operate the turbine, and further makes possible an unusually thin blade.

The blades of the preferred form of the invention are configured to have a uniform discharge velocity along the length of the blade. This makes the blade length uncritical, and makes possible the use of only a few basic blade patterns for all propeller sizes of from about ten inches in diameter to fifteen feet or more, since the basic pattern need only be enlarged or trimmed to change its size. Changes in camber become unnecessary.

The achievement of a uniform discharge velocity involves both theoretical and empirical considerations. The actual value of the discharge velocity depends on all the geometric proportions of the design and the rotational speed of the impeller. At a constant rotational speed and a constant ratio of the propeller diameter to radius of blade curvature (producing the camber), the vertical discharge velocity, u, in any section along the radius of the blade is a function of the horizontal linear velocity, v, the angle of attack, $\alpha$, and the angle of the trailing edge of the blade, $\phi$. However, for a constant rotational speed, the linear velocity, v, is directly proportional to the radial distance from the propeller centerline to the radius of concern, r.

Therefore, the discharge velocity u at any radius, r, may be expressed as a function of the product of r and the tangent of the angular difference between $\phi$ and $\alpha$. In other words, $$u = k\, r \operatorname{Tan}(\phi - \alpha)$$

where k is a proportionality constant.

In the preferred embodiment, since the leading edge of the blade is straight and parallel to the blade radius, the angle of approach is constant; therefore the angle of the attack, $\alpha$, varies.

If one calculates the value of u at the blade tip then moves inwardly toward the hub the value of r decreases. The only way to keep u constant is to increase the value of the term Tan $(\phi - \alpha)$ proportionately. Since $\alpha$ is constant, this means the angle of the trailing edge, $\phi$, must increase. Since the radius of curvature of the blade is also predetermined and constant, the only way to increase is to increase the blade width. Accordingly, as one moves along the blade from tip to root, the radius decreases and the blade gets wider.

The foregoing theoretical considerations must be confirmed by actual testing to determine precise performance values, because both the calculation of and the drag and lift coefficients are empirical, subject to some variation depending on surface roughness, edge effects, head losses in the fluid as it circulates through the tank, etc.

The projected height of the blade is low, as shown in FIG. 2 by arrow 71. This enhances the axial flow pattern of the turbine assembly by reducing off-axial flow components.

The foregoing considerations have made the construction of blades possible pursuant to the invention which are very efficient. The power required to turn the preferred blades has been found to be 73% lower than the four-bladed axial flow turbine with 45° pitched blades which is in current wide use in the marketplace.

Figure 7:
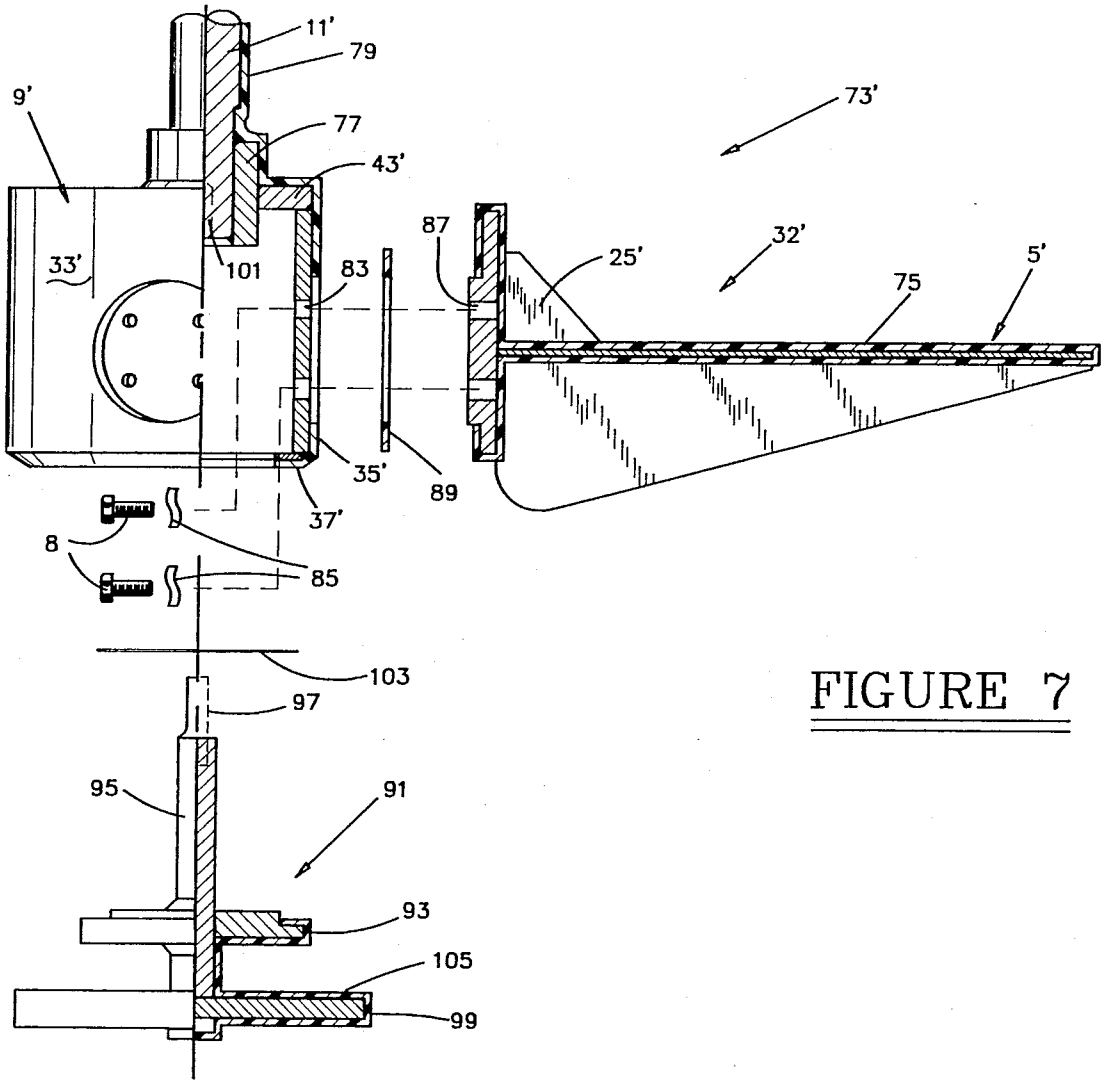
FIG. 7 is an exploded, partially cross-sectioned side view of another embodiment of the invention.

At times, blade assemblies of the invention can be useful for mixing fluids too corrosive for stainless steels and alloys. A mixing blade assembly 73 particularly suited for such application is shown in FIG. 7. Assembly 73 is very similar to assembly 1 in FIG. 4, and like parts are ascribed like reference numerals with a prime (') suffix, with reference being to the earlier description of those parts. The most significant aspect of assembly 73 is the provision of polymeric coatings such as rubber on the exterior of the assembly to protect the device from the deleterious effects of the fluids to which it is exposed. Impeller assembly 73 includes a turbine blade assembly 32' with a blade 5', a support 23' and gussets 25'. The entire unit has a rubber coating 75. The device further includes hub assembly 9' mounted on a shaft 11'. Hub 9' has a triangular configuration as previously described, with side plates 33', 35' and 37'. A top plate 43' is welded to the upper surfaces of the side plates and a cylindrical attachment piece 77 welded to an appropriately shaped opening in top plate 43'. Device 73 does not have a step key corresponding to key 51 in device 1, and piece 77 is therefore welded to shaft 11'. A bottom plate 39' is similarly welded to the lower edges of the respective side plates. The shaft and hub assembly has a rubber coating 79 for protecting the surfaces of the components exposed to the fluid. There are no open seams or joints through which the corrosive material could attack exposed metal. In order to secure blade assembly 32' to side plate 35', a set of bolts 81 with lockwashers 85 are inserted through a set of bolt holes 83 in side plate 35', and into threaded bolt holes 87 in support plate 23' of assembly 32'. A Teflon sealing gasket 89 is interposed between plate 23' and side plate 35' for sealing the joint between support plate 23' and plate 35' when bolts 81 are tightened.

A bottom closure plate assembly 91 is provided for closing the bottom of hub 9'. Assembly 91 includes a closure plate 93 having a vertical post 95 and a threaded end portion 97 coaxial with post 93. A handle 99 is provided opposite plate 93. A threaded tapped hole 101 is provided in the free end of shaft 11' for receiving threaded portion 97. In order to close the lower end of hub 9', portion 97 is inserted into hole 101 in shaft 11' and shaft 95 is rotated by means of handle 99 to secure unit 91 in place. A Teflon gasket 103 is preferably interposed between plate 93 and bottom hub plate 37' for preventing bonding between the coated members, and for providing a seal between these members. Closure plate assembly 91 has a rubber coating 105 for protecting the assembly against the corrosive effects of the environment as discussed above.

Figure 8:
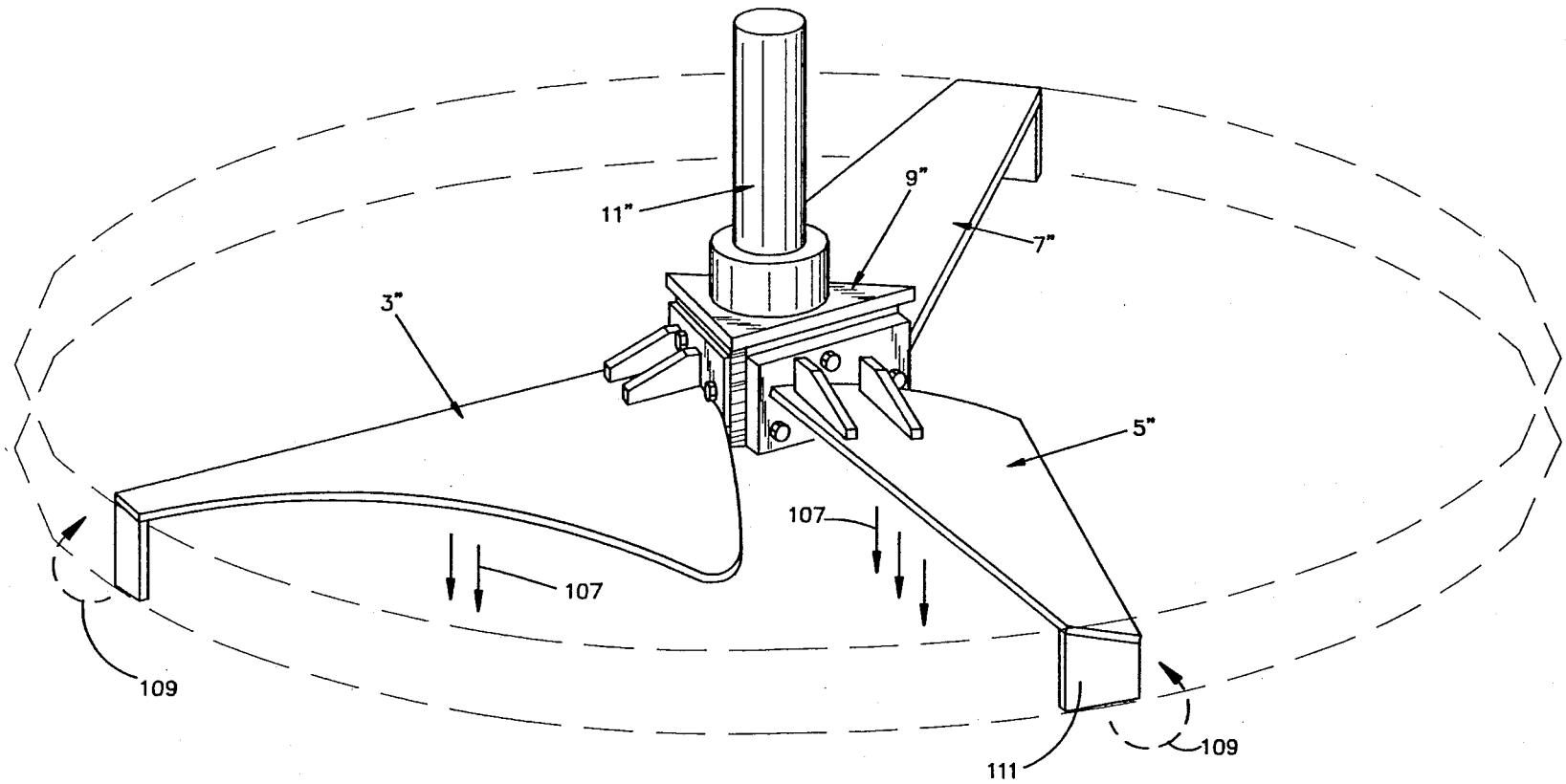
FIG. 8 is a perspective view of another embodiment of the invention.

Flow in axial flow turbines, including those of the present invention, is ideally wholly axial. However, there is frequently an axial component of fluid flow around the tips of the impeller blades which detracts from the performance of the machine. Referring to FIG. 8, an axial flow turbine is shown having blades 3'', 5'' and 7'' similar to blades 3, 5 and 7 described earlier extending radially from a hub 9'' mounted at the lower, free end of a shaft. The normal, desired axial flow pattern is shown schematically by arrows 107. However, due to such factors as eddy currents, convection currents, turbulence and the like, radial flow represented by arrows 109 can occur around the blade tips. The present invention provides according to the embodiment of FIG. 8, barriers 111 depending from the tips of the respective blades to block such radial flow and thus enhance the performance of the turbine. Such barriers can be provided at the tips of the blades as shown in solid lines, or they can be in the form of a continuous band or shroud as indicated by cylinder 113 shown in dotted lines.

The invention has been described in detail with particular emphasis on the preferred embodiments, but it should be understood that variations and modifications within the spirit and scope of the invention may occur to those skilled in the art to which the invention pertains.

We claim:

1. A versatile mixing blade construction for mixing liquids in containers which blade reduces the need for additional blades as a depth of the liquid to be mixed increases, said mixing blade construction comprising:

a hub means attachable to a drive shaft for rotation about an axis of rotation; and, impeller blade means mountable on said hub means, said impeller blade means including a root portion for attachment to said hub means and a tip portion forming a free end of said blade means, said blade means having a curved, airfoil configuration with a leading edge extending from said tip portion to said root portion and being straight and transverse to the axis of rotation and a trailing edge tapering from a first position close to the leading edge of said means at the tip portion to a second position farther than said first position from the leading edge near the root portion wherein said trailing edge is straight between said first and said second positions;

said blade means having an angle of attack substantially below the stall angle for avoiding blade surface turbulence and flow separation when said blade construction is mixing liquids whereby said blade construction compensates for and takes into account all drag effects resulting from mixing said liquid.

2. The invention according to claim 1 wherein said blade means has an upper surface and a lower surface, and said leading edge has a semi-cylindrical convex surface interconnecting said upper and lower surfaces.

3. The invention according to claim 1 wherein said trailing edge includes a part tapering from said second position towards said leading edge at the root portion.

4. The invention according to claim 3 wherein said blade means has parallel upper and lower surface, and said trailing edge is perpendicular to each of said upper and lower surfaces.

5. The invention according to claim 1 wherein the chamber of said blade means increases from the tip portion to said second position to provide said blade means with a uniform discharge velocity when mixing fluids in a container.

6. The invention according to claim 1 wherein the exterior surface of said mixing blade construction has a polymeric coating.

7. The invention according to claim 1 and further including mounting means attachable to said hub means, said mounting means having a generally flat attachment surface rotatable with said hub means; and wherein said blade means has flat end portions at said root portion engaged with said flat attachment surface, said blade means being devoid of stresses tending to distort said airfoil configuration.

8. The invention according to claim 1 wherein said straight leading edge is non-intersecting with said axis of rotation and is spaced with respect to the direction of rotation ahead of a radius extending from said axis of rotation which radius is parallel to and in the same plane as said straight leading edge.

* * * * *